US006813459B2

(12) United States Patent
Kishigami

(10) Patent No.: US 6,813,459 B2
(45) Date of Patent: Nov. 2, 2004

(54) ROTARY DEVELOPING DEVICE

(75) Inventor: Minoru Kishigami, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/325,953

(22) Filed: Dec. 23, 2002

(65) Prior Publication Data

US 2003/0147671 A1 Aug. 7, 2003

(30) Foreign Application Priority Data

Jan. 11, 2002 (JP) ..... 2002-004509
Jan. 11, 2002 (JP) ..... 2002-004510
Jan. 28, 2002 (JP) ..... 2002-017877

(51) Int. Cl.[7] ..... G03G 15/01
(52) U.S. Cl. ..... 399/227
(58) Field of Search ..... 399/223, 226, 399/227, 228; 74/321, 396, 397, 405

(56) References Cited

U.S. PATENT DOCUMENTS 4,030,445 A * 6/1977 Takenaga et al. ..... 399/227
5,787,328 A * 7/1998 Sugihara et al. ..... 399/227

FOREIGN PATENT DOCUMENTS

JP 61077873 A * 4/1986 ..... G03G/15/01

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A rotary developing device having a cylindrical rotary developing unit, and a plurality of development members mounted around the periphery of the rotary developing unit. The rotary developing unit is driven to bring one of the development members to the developing position facing a photoreceptor and subsequently the transmission of the driving power to the development member is conducted. In the rotary developing device, the driving direction of the development members at a driving power transmitting section is set to be the same as the driving direction of the rotary developing unit and a simple additional structure employing an electromagnetic clutch or a one-way clutch is applied to the driving power transmitting section, thereby avoiding a collision of tooth tops between gears, damping the impact generated by a collision, and reducing vibration and damage of tooth tops. Therefore, the production of image defects due to registration error are prevented.

11 Claims, 13 Drawing Sheets

Driving-side Gear

Driven-side Gear

Details of Tooth Configuration

ROTARY DEVELOPING DEVICE

BACKGROUND OF THE INVENTION

The present invention relates to a rotary developing device comprising a cylindrical rotary developing unit, a plurality of development members mounted around the periphery of said rotary developing unit, and a driving means, wherein the rotary developing unit is driven by the driving means to bring one of the development members to the developing position facing a photoreceptor and subsequently the transmission of the driving power to the development member is conducted.

In a conventional multi-color image forming apparatus employing a rotary development method, a plurality of development members are mounted along the periphery of a rotary developing unit and the rotary developing unit is driven to sequentially bring the development members to a developing position so as to carry out the development operation. For this, a driving means for rotating the rotary developing unit and a driving means for rotating a development roller or the like built in each development member mounted on the rotary developing unit are separately provided.

The rotary developing unit with the aforementioned plurality of development members is generally cylindrical and is provided around its outer periphery with heavy parts such as development rollers as developer carriers which are metallic rollers or metallic shafts covered by plastic material for developing latent images formed on a latent image carrier such as a photoreceptor. Accordingly, the rotary developing unit has large moment of inertia.

In case of a rotary developing unit having four color development members as a general example for multi-color printing, development is carried out by driving the rotary developing unit to rotate 90 degrees four times so as to sequentially bring the four color development members to a position facing the photoreceptor. As arrangements for retaining the rotary developing unit in the state after the rotary developing unit is stopped at the developing position where the development operation is conducted, there are a case of using the retaining force of a motor itself and a case of providing an engaging member separately.

As the moment of inertia is large for conducting 90-degree rotation of the rotary developing unit, the motor as the driving means must produce a large force in proportion as the moment of inertia. For raising the printing speed, the increase in speed of conducting the 90-degree rotation is effective. However, as the speed of the 90-degree rotation is increased, the acceleration during the rotation is increased. Since the power required for the driving means should be a square of the acceleration relative to the moment of inertia, the required power must be great.

The required power for rotating the rotary developing unit produces in turn the contrary effect on stopping the rotary developing unit. For stopping the rotary developing unit, the driving means carries out a braking function to reduce the rotational force of the rotary developing unit. Ideally, the rotational force of the rotary developing unit is reduced to zero by the braking force just before the rotary developing unit is stopped.

In the electrophotographic technology, a stepping motor is generally used for driving the rotary developing unit because it can achieve the short-time acceleration and achieve the higher positioning accuracy with relatively simple control and a DC brushless motor is generally used for driving the development members because it can provide high torque efficiency and it never breaks down due to load fluctuation.

When a DC brushless motor, not a stepping motor, is used for driving the rotary developing unit, an encoder is fixed to the output shaft of the motor because the DC brushless motor has poor positioning accuracy. The rotation angle of the motor is determined from signals from the encoder. According to this information, the rotation angle of the rotary developing unit is controlled. In addition, the DC brush less motor has poor acceleration. Accordingly, since a time lag is generated in transmitting and receiving of the signals from the encoder, it is impossible to rotate the rotary developing unit at high speed.

The feedback control according to the signals from the encoder increases the load on a CPU as a controller. The increase in load on the CPU restricts the entire operation of the apparatus. From the above reasons, the use of a stepping motor is common for driving the rotary developing unit. However, even stepping motor has problems such as vibration, noise, and smaller flexibility for load fluctuation. Because of the smaller flexibility, the motor should break down to stop the operation at its worst. In addition, stepping motor is expensive as compared to other motors such as DC brushless motor relative to the same torque.

On the other hand, nowadays there are some types employing a stepping motor, not a DC brushless motor, for driving the development members. One of triggers for the employment of stepping motor is that decrease in cost of stepping motors has been achieved as compared to other motors. Moreover, its shorter acceleration/deceleration time has come to the fore as a merit. For achieving the increase in printing speed, it is desired to shorten the acceleration time for raising the speed of a development roller to the steady state velocity as well as the time for switching colors according to the rotation of the rotary developing unit.

For actually switching between the rotary unit driving action and the development member driving action, the rotary developing unit is driven to rotate 90 degrees four times so as to sequentially bring development cartridges to a position facing the photoreceptor and a development input gear of the development cartridge, brought to the aforementioned position, is meshed with a development member driving gear, whereby the transmission of the driving power to the development roller is conducted. During this, the pitch circles of the gears meet so that their tooth tops may collide with each other in some cases. In the event of collision, the driving means may develop trouble (may stop due to breakdown of the motor) and may produce image defects due to vibration generated by the collision.

Due to backlash and deflection existing in a driving-side gear train and deformation of the rotary developing unit itself, rotational force may remain. The remaining rotational force is transmitted as vibration to the entire device through the driving means when the rotary developing unit is stopped. The vibration may be transmitted to an exposure means or a latent image carrier. In this case, the vibration produces registration error during formation of latent image. The vibration may be transmitted to a transferring section. In this case, the vibration produces transferring error.

Further, when a driving means for rotating the development roller starts to operate just after the rotary developing unit is stopped, uneven rotation of the driving means or vibration generated in the driving means is transmitted to the entire device. Similar to the vibration generated at the stop of the rotary developing unit, the vibration after the stop of the rotary developing unit produces image defects such as registration error.

If the aforementioned two driving means are of different kinds or having lots of different sizes, the driving means have different rotation and vibration characteristics. Even when the driving means have substantially the same vibration characteristics, since these are disposed in different places, these are influenced by the characteristics of the respective places when subjected to vibration. Vibrations generated by different vibration sources may be composed of different components. These vibrations may not damp each other and may be sometimes superposed to by synthesized i.e. amplified, thus producing image defects such as errors in longer period.

When a stepping motor is used for driving the rotary developing unit and a DC brushless motor is used for driving the development roller, the stepping motor is in the stopped state during the action of driving the development roller (this action will be sometimes referred to as "the development member driving action"). The stopped state means that the motor is energized with a minute electric current to retain the rotor at a predetermined position. In case of having an external locking mechanism for retaining the rotary developing unit at a predetermined position, it is possible to cancel the retention of the rotor. However, once the retention of the rotor is cancelled, the position of the rotor should be unstable. In this case, the position of the first exciting phase for the next action for driving the development roller is not certain, causing position error and thus reducing the rotational accuracy of the rotary developing unit. Consequently, the retention of the rotor is indispensable to maintain the rotational accuracy of the rotary developing unit.

However, the retention of the rotor requires the consumption of electric power. Since the motor is energized but the motor itself does not rotate, the energy applied to the motor becomes heat energy, increasing the temperature. The increase in temperature leads to drop in torque.

When stepping motors are used for driving the rotary developing unit and for driving the development roller, respectively, drivers for controlling the stepping motors and timers for controlling the drivers are required, respectively. Besides the aforesaid timers, another timer of a longer cycle is also required for retaining the stepping motor for driving the rotary developing unit in the stopped state during the development member driving action.

In the rotary developing unit, the amounts of developers in the respective developer cartridges vary according to the development operation so that the load balance of the cylinder varies delicately. The variation in load balance increases the moment of inertia in the rotary developing unit, thereby increasing the torque required to the stepping motor. Accordingly, it is required to periodically match the motor torque in a very short cycle during the action of driving the rotary developing unit (this action will be sometimes referred to as "the rotary unit driving action"). This is because the timer of a very short cycle is used. If the timer of a very short cycle is used also for retaining the stopped state, the CPU should be overdriven and thus restrict the other operation. Addition of such drivers and timers makes the substrate structure complex and also makes the control, including the control of the CPU, complex. It should be understood that the addition of such drivers and timers increases superposed driving time, leading to increase in electrical consumption.

SUMMARY OF THE INVENTION

It is an object of the present invention to quickly damp vibration generated according to the rotation of a rotary developing unit and the rotation of development rollers. It is another object of the present invention to avoid a collision of tooth tops between gears which may occur due to switching between the rotary unit driving action and the development member driving action and damp the impact generated by the collision, thereby reducing vibration and transferring error. It is still another object of the present invention to shorten the time for switching between the rotary unit driving action and development member driving action and prevent the generation of vibration, thereby reducing image defects and image deterioration resulting from registration error.

For this, according to the present invention, a rotary developing device comprises: a cylindrical rotary developing unit, a plurality of development members mounted around the periphery of said rotary developing unit, a rotary developing unit driving section for driving said rotary developing unit by a driving means, and a driving power transmitting section for transmitting the driving power by said driving means to said development members at a developing position, wherein said rotary developing unit is driven by said driving means to bring one of said development members to the developing position facing a photoreceptor and subsequently the transmission of the driving power to said development member is conducted, and is characterized in that, in said driving power transmitting section, the driving direction of said development members is set to be the same as the driving direction of said rotary developing unit and that said driving power transmitting section is provided with a clutch for coupling/uncoupling a gear train.

It is preferable that said driving power transmitting section has a supporting means for supporting a shaft of a gear to be meshed with a development input gear to transmit the driving power to the development member in such a manner that the shaft can swing along a radial line extending from the center of said rotary developing unit and that said driving power transmitting section is provided with a clutch for coupling/uncoupling a gear train and, in said driving power transmitting section, the driving direction of said development members is set to be the same as the driving direction of said rotary developing unit. Further, it is preferable that said supporting means is positioned downstream of said driving means in the rotational direction of said rotary developing unit.

It is preferable that said clutch is a one-way clutch which is disposed between a gear to be meshed with the development input gear of said rotary developing unit and the driving shaft of said gear in said driving power transmitting section.

It is preferable that, as said driving means, a common driving means is provided for driving the rotary developing unit and driving the development members and said rotary developing unit driving section includes a clutch for coupling and uncoupling a gear train relative to an input gear of the rotary developing unit. Further, it is preferable that said rotary developing unit has a locking mechanism for retaining the stopped state during the suspension of the driving of the rotary developing unit and, in said driving means, reverse pulse is applied to coincide with the direction of vibration of a motor pinion just after the development member driving action is finished. Furthermore, it is preferable that said common driving means is set such that the rotational direction thereof for driving said rotary developing unit and the rotational direction thereof for driving said development member are opposite to each other.

According to the present invention, a rotary developing device comprises: a cylindrical rotary developing unit, a plurality of development members mounted around the periphery of said rotary developing unit, a rotary developing unit driving section for driving said rotary developing unit by a driving means, a driving power transmitting section for transmitting the driving power by said driving means to said development members at a developing position, a one-way clutch which is arranged between said driving means and the driving power transmitting section to couple/uncouple a gear train, and a retaining means for retaining said rotary developing unit at a developing position, wherein said rotary developing unit is driven by said driving means to bring one of said development members to the developing position facing a photoreceptor and subsequently the transmission of the driving power to said development member is conducted, and is characterized in that, in said driving power transmitting section, the driving direction of said development members is set to be the same as the driving direction of said rotary developing unit, and that said retaining means retains said rotary developing unit at said developing position during the development member driving action and said driving means is energized to rotate in reverse at the end of the development member driving action and subsequently the retention of the rotary developing unit is cancelled.

It is preferable that said one-way clutch is disposed between a gear to be meshed with the development input gear of said rotary developing unit and the driving shaft of said gear in said driving power transmitting section and that, as said driving means, a common driving means is provided for driving the rotary developing unit and driving the development members and said rotary developing unit driving section includes a clutch for coupling and uncoupling a gear train relative to an input gear of the rotary developing unit. Further, it is preferable that said retaining means comprises a locking mechanism having a claw portion for stopping the rotation of said rotary developing unit and an operating portion for engaging/disengaging the claw portion.

It is preferable that, as said driving means, driving means are separately provided for driving said development members and for driving said rotary developing unit and the driving means for driving said rotary developing unit also functions as said retaining means and that, when the driving means drives in reverse at the end of said development member driving action, reverse pulse is applied to coincide with the direction of vibration of a motor pinion just after the development member driving action is finished. It is preferable that said driving means is a stepping motor. Further, it is preferable that, in the driving power transmitting section, the development member driving action is conducted via a development input gear mounted to the frame of said rotary developing unit.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF PREFERRED EMBODIMENTS

Figure 1:
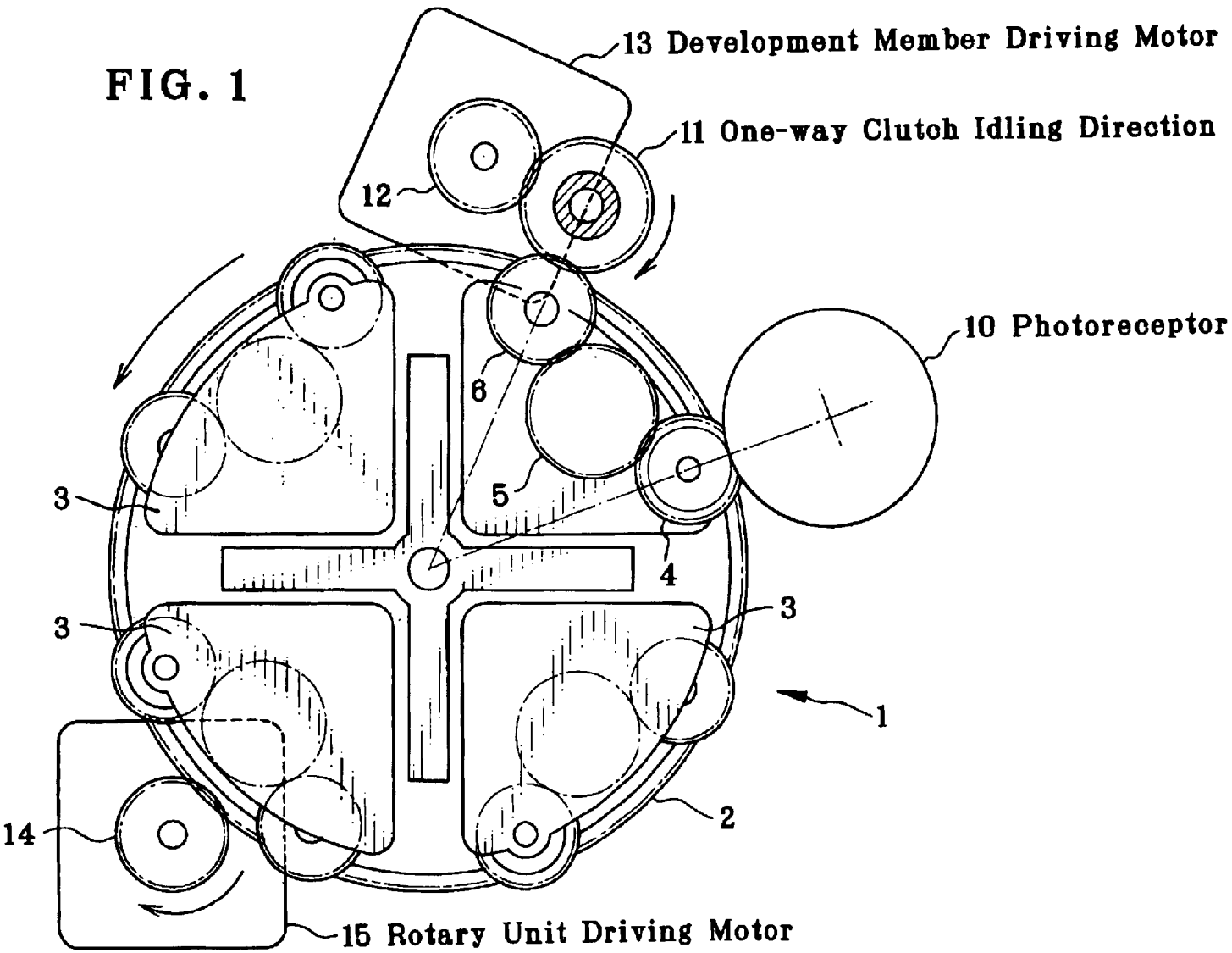
FIG. 1 is an illustration showing an embodiment of a rotary developing device according to the present invention.
Figure 2:
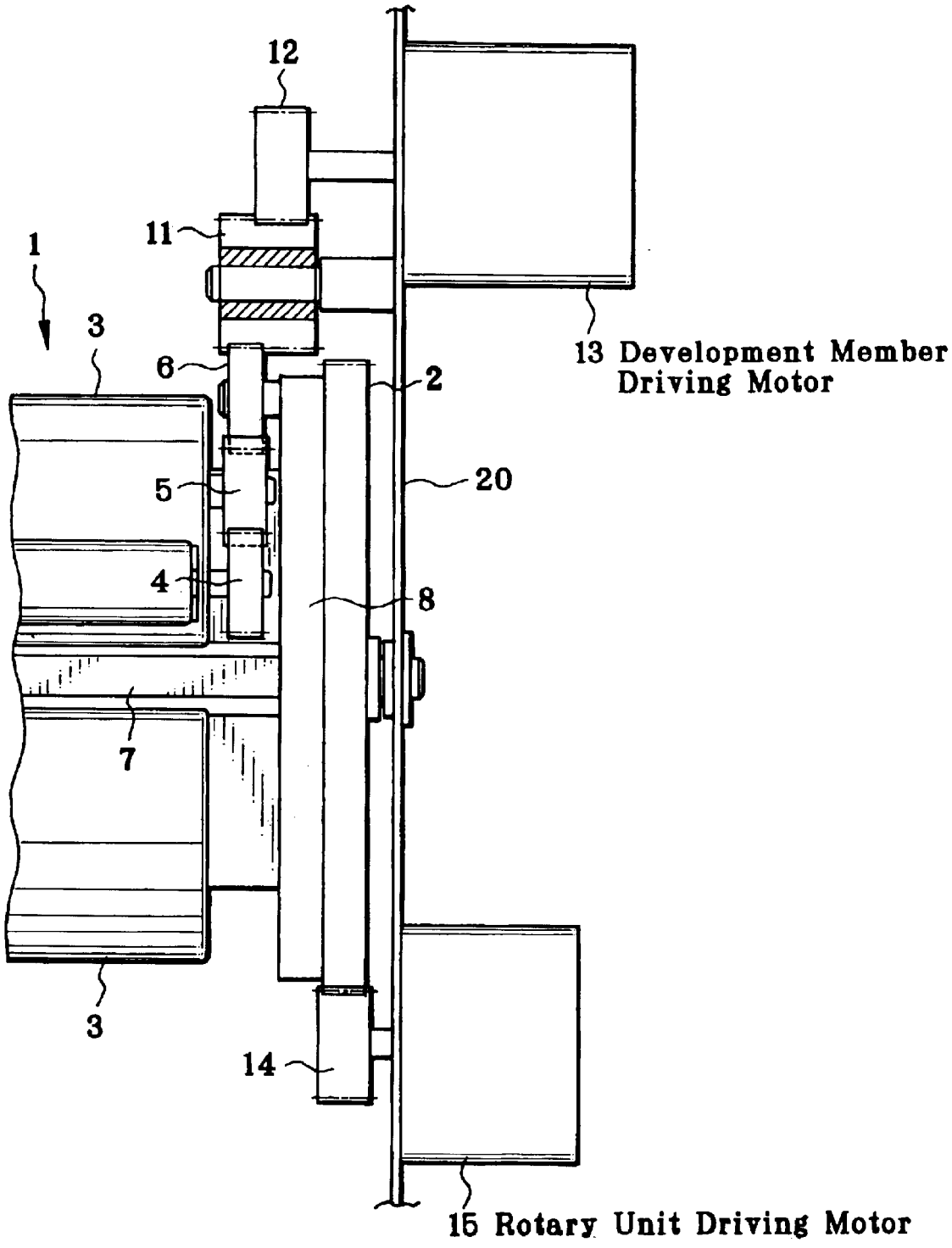
FIG. 2 is a side view of a gear train section of the rotary developing device shown in FIG. 1.

Hereinafter, embodiments of the present invention will be described with reference to the drawings. FIG. 1 is an illustration showing an embodiment of a rotary developing device according to the present invention, FIG. 2 is a side view of a gear train section of the rotary developing device. In these drawings, numeral 1 designates a rotary developing unit, 2 designates a rotary input gear, 3 designates each development cartridge, 4 designates a development roller gear, 5 designates each idle gear, 6 designates a development input gear, 10 designates a photoreceptor, 11 designates a development member driving gear, 12 designates a motor pinion, 13 designates a development member driving motor, 14 designates a motor pinion, and 15 designates a rotary unit driving motor.

In FIG. 1, the rotary developing unit 1 has a substantially cylindrical shape and is provided around its periphery with a plurality of development cartridges 3 to develop latent images formed on a latent image carrier such as a photoreceptor 10. The rotary developing unit 1 is a structural example of a four-color developing unit with development cartridges 3 for four colors of yellow Y, cyan C, magenta M, and black K. The rotary developing unit 1 has a rotary input gear 2 coaxially disposed with the rotation axis thereof and is driven to rotate by a rotary unit driving motor 15 as a driving means through a gear train of connecting a motor pinion 14 of the rotary unit driving motor 15 and the rotary input gear 2. The rotary developing unit 1 is driven to rotate 90 degrees four times so as to sequentially bring the development cartridges 3 for four colors to a position facing the photoreceptor 10, respectively, thereby carrying out development.

Each development cartridge 3 comprises a development roller as a developer carrier which is a metallic roller or a metallic shaft covered by an elastic member. The development roller is driven by a development member driving motor 13 as a driving means through a gear train composed of a motor pinion 12 of the development member driving motor 13, a development member driving gear 11, a development input gear 6, an idle gear 5, and a development roller gear 4. Thus, the development operation is carried out. During this development operation, the rotary developing unit 1 is retained in the stopped state by the rotary unit driving motor 15.

The rotary developing unit 1 is mounted to a body frame 20 as well as the development member driving motor 13 and the rotary unit driving motor 15 as shown in the side view of FIG. 2 and has a rotary shaft 7 which is rotatably supported by bearings. As for the gear train for driving each development cartridge 3, the development input gear 6 for each development cartridge 3 is mounted to a rotary frame 8 while the idle gear 5, meshed with the development input gear 6, and the development roller gear 4 are mounted to each development cartridge 3. The development cartridges 3 are individually detachable. The idle gear 5 of each development cartridge 3 is meshed with the corresponding development input gear 6 fixed to the rotary frame 8 when the development cartridge 3 is installed.

Each development input gear 6 is fixed to the rotary frame 8 in such a manner that the development input gear 6 can be meshed with the development member driving gear 11 fixed to the body frame 20, while it can also be meshed with the idle gear 5 of the corresponding development cartridge 3. Therefore, even when the development cartridges 3 are replaced, variation in quality of the development cartridges 3, if any, does not affect the mesh between the development member driving gear 11 and the development input gear 6. After a development cartridge 3 is installed, the mesh between the development member driving gear 11 and the idle gear 5 remains until the replacement of the development cartridge 3. On the other hand, the mesh between the development input gear 6 and the development member driving gear 11 is repeatedly achieved and cancelled according to the rotary unit driving action and the development member driving action. The tooth tops of the development input gears 6 and the development member driving gear 11 are therefore easily damaged so that their lives are shortened. According to the structure of the present invention, however, the prolongation of the lives of driving power transferring parts such as the development member driving gear 11 and the development input gears 6 can be achieved.

The transmission of driving power is conducted on the path of rotational contact of the rotary developing unit 1 and the pitch circles of the gears (the development input gear 6 and the development member driving gear 11) meet so that their tooth tops may collide with each other in some cases. In the event of collision, the driving means may develop trouble (may stop due to power swing of the motor), easily damaging the tooth tops and shortening their lives. For this, by employing a one-way clutch in the development member driving gear 11, as some tooth tops intend to collide with each other during the rotational action, the one-way clutch can run idle, thereby avoiding such a collision and preventing the driving means from developing trouble.

The development member driving gear 11 employing the one-way clutch idles in a direction of rotating the rotary developing unit 1 by the rotary unit driving motor 15 as the driving means. On the other hand, during the development operation, the rotary unit driving motor 15 is held in the stopped state and the development member driving gear 11 is rotated by the development member driving motor 13 as the driving means in the reverse direction of the idling direction of the development member driving gear 11 to drive the development input gear 6. In this case, therefore, the rotational direction of the rotary input gear 2 and the rotational direction of the development input gear 6 are the same.

One-way clutch is much advantageous than electromagnetic clutch. For example, unlike electromagnetic clutches, the coupling and uncoupling can be automatically conducted without necessity of conduction so that no control is required and no electrical component such as a controller for controlling the ON/OFF is required. The one-way clutch needs no electricity, thereby achieving power saving and needs no time for conducting the coupling and uncoupling. That is, the switching is conducted at very high speed. Further, the one-way clutch can be enough small to be built in the gear and yet transmit a large torque so that it has high degree of freedom of design.

Figure 3:
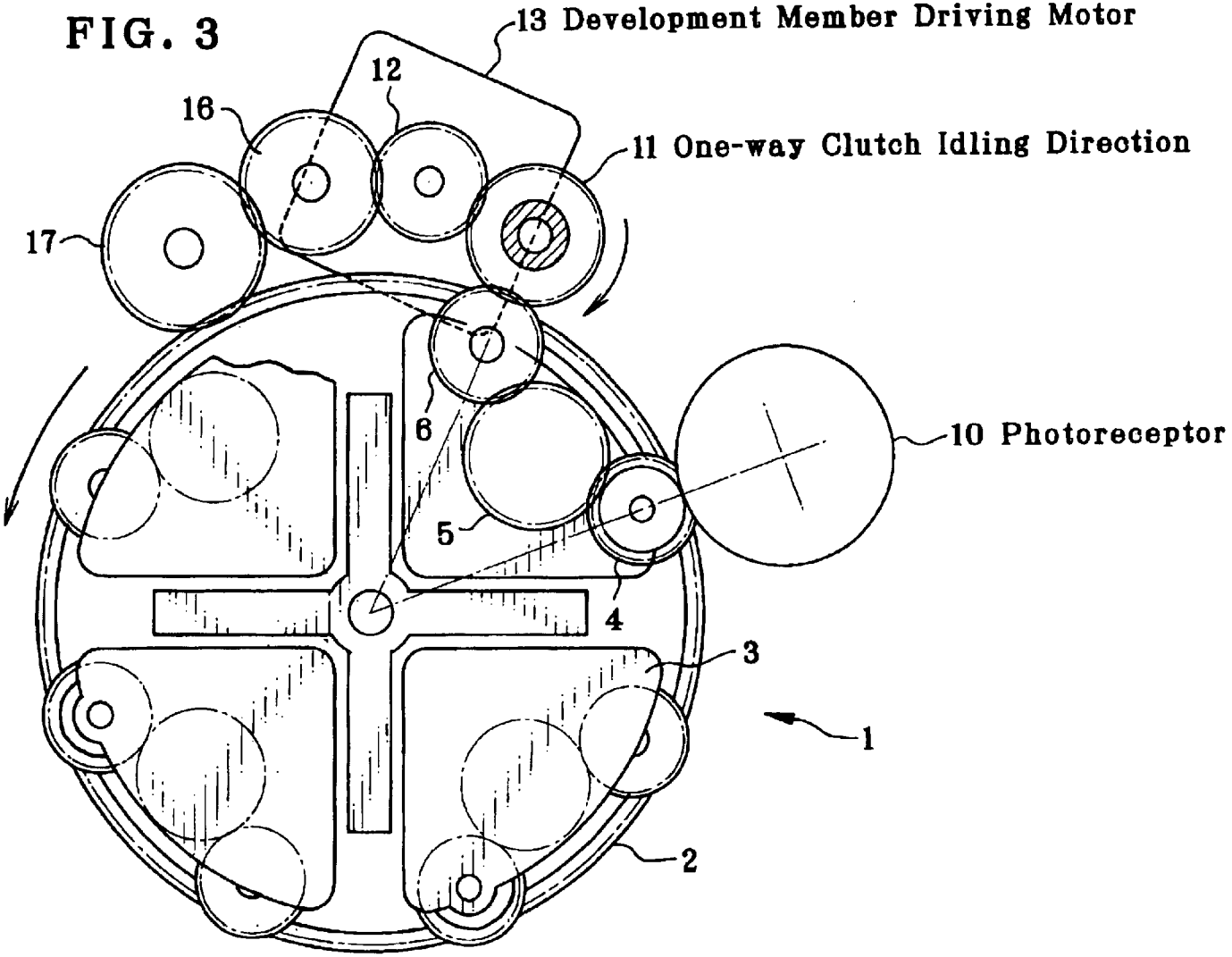
FIG. 3 is an illustration showing another embodiment of a rotary developing device according to the present invention.
Figure 4A:
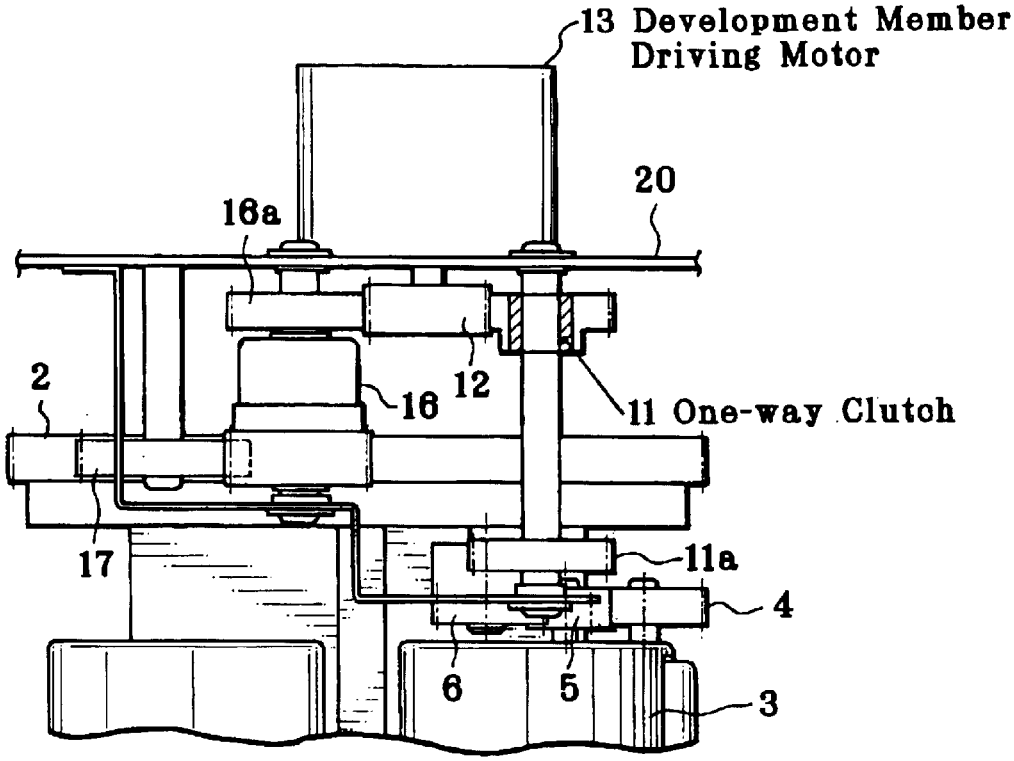
FIGS. 4(A), 4(B) are side views each showing a gear train section of the rotary developing device shown in FIG. 3.
Figure 4B:
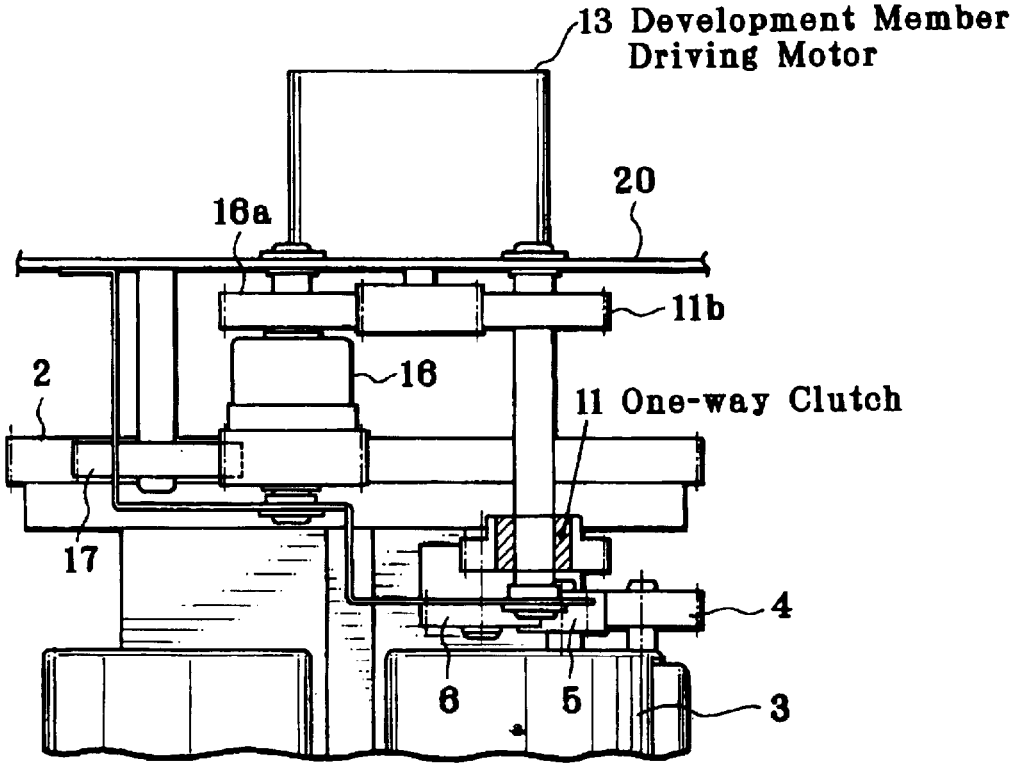

FIG. 3 is an illustration showing another embodiment of a rotary developing device employing a one-way clutch and FIGS. 4(A), 4(B) are side views each showing a gear train section of the rotary developing device shown in FIG. 3. Though separate motors (two motors) are employed as driving means for the rotary unit driving action and the development member driving action, respectively in the aforementioned embodiment, a single motor is employed as a common driving means for the rotary unit driving action and the development member driving action in this embodiment of FIG. 3. FIGS. 4(A) and 4(B) are side views showing examples of different arrangements of a one-way clutch in a development member driving gear, respectively.

In FIG. 3, a development member driving motor 13 drives a motor pinion 12 to rotate in the clockwise direction, thereby conducting the rotary unit driving action and drives the motor pinion 12 to rotate in the counter-clockwise direction, thereby conducting the development member driving action. To make the single motor capable of conducting the rotary unit driving action and the development member driving action, a development member driving gear 11 employing a one-way clutch is arranged between the motor pinion 12 and a development input gear 6, while a gear 16 with an electromagnetic clutch (hereinafter, referred to as the electromagnetic clutch gear 16) is arranged between the motor pinion 12 and a rotary unit driving gear 17.

When the motor pinion 12 is driven to rotate in the clockwise direction for conducting the rotary unit driving action, the electromagnetic clutch gear 16 is set into its coupled state to drive the rotary input gear 2 and the one-way clutch idles to separate the power transmission to the developer cartridges 3. When the motor pinion 12 is driven to rotate in the counter-clockwise direction for conducting the development member driving action, the electromagnetic clutch gear 16 is set into its uncoupled state to separate the power transmission to the rotary input gear 2 and the motor pinion 12 drives one of the development input gears 6 via the development member driving gear 11.

The electromagnetic clutch gear 16 which is meshed with the rotary unit driving gear 17 for conducting the rotary unit driving action and the development member driving gear 11 which is meshed with one of the development input gears 6 for conducting the development member driving action are mounted to a body frame 20 as shown in the side views of FIGS. 4(A), 4(B). The development member driving gear 11 employing the one-way clutch (hereinafter, referred to as the one-way clutch gear 11) is arranged at a side where it can be meshed with the motor pinion 12 or at a side where it can be meshed with one of the development input gears 6, the arrangement in which the one-way clutch gear 11 is arranged to be meshed with the motor pinion 12 is shown in FIG. 4(A), while the arrangement in which the one-way clutch gear 11 is arranged to be meshed with one of the development input gears 6, i.e. the one-way clutch is fitted between a gear to be meshed with one of the development input gears 6 and the shaft of the gear is shown in FIG. 4(B). In the arrangement shown in FIG. 4(B), the shaft is driven by mesh between a gear 11*b* and the motor pinion 12. The electromagnetic clutch gear 16 is connected to the shaft of the gear 16*a* which is meshed with the motor pinion 12.

In the arrangement shown in FIG. 4(A) in which the one-way clutch gear 11 is arranged to be meshed with the motor pinion 12, when a gear 11*a*, which is a counter part of the one-way clutch gear 11 and is meshable with the development input gear 6, collides with the development input gear 6, the gear 11*a*, the shaft, and the ratchet gear fitted in the one-way clutch gear 11 idle. On the other hand, in the arrangement shown in FIG. 4(B) in which the one-way clutch gear 11 is arranged to be meshed with one of the development input gear 6, when the one-way clutch gear 11 collides with the development input gear 6, only the gear 11 which is meshable with the development input gear 6 idles. Therefore, the arrangement shown in FIG. 4(A) operates with a heavy load, making collision relief between tooth tops difficult, in comparison to the arrangement shown in FIG. 4(B) according to the position of the one-way clutch gear 11. Therefore, the arrangement shown in FIG. 4(B) has an advantage over the arrangement shown in FIG. 4(A).

Figure 5:
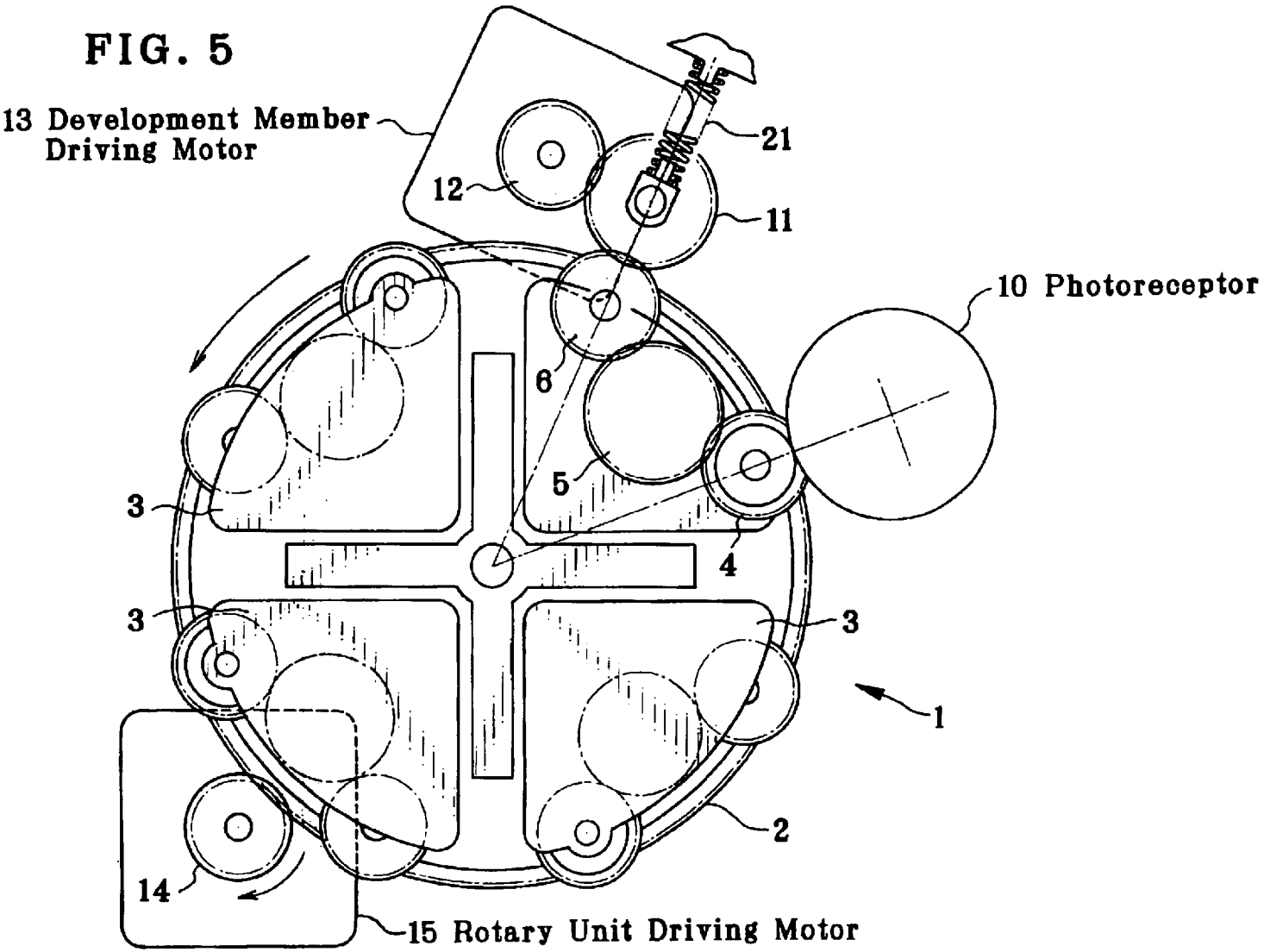
FIG. 5 is an illustration showing a rotary developing unit of a dual motor driven type with an arrangement for preventing the damage of tooth tops at a driving power transmitting section relative to a development input gear.
Figure 6:
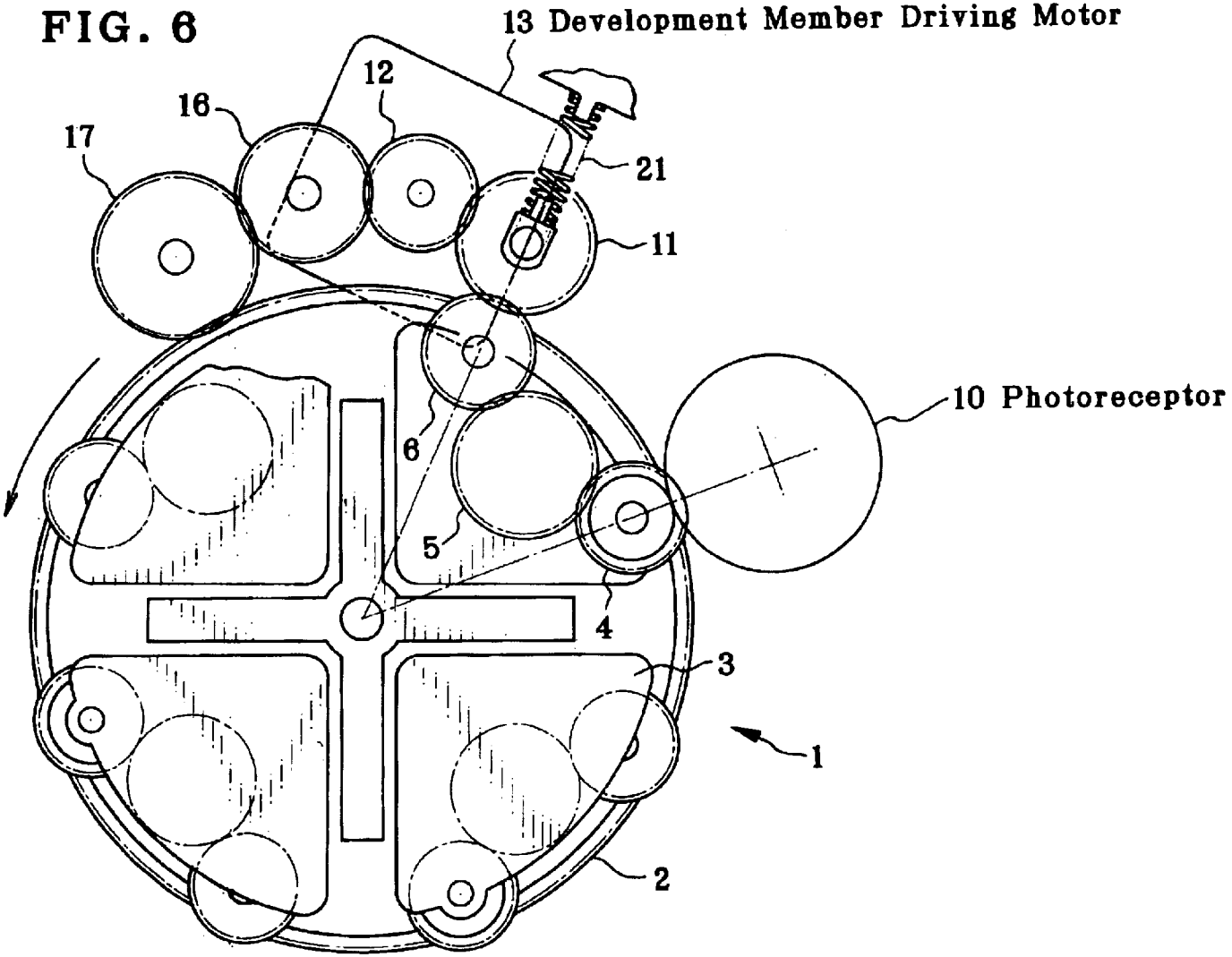
FIG. 6 is an illustration showing a rotary developing unit of a single motor driven type with an arrangement for preventing the damage of tooth tops at a driving power transmitting section relative to a development input gear.
Figure 7:
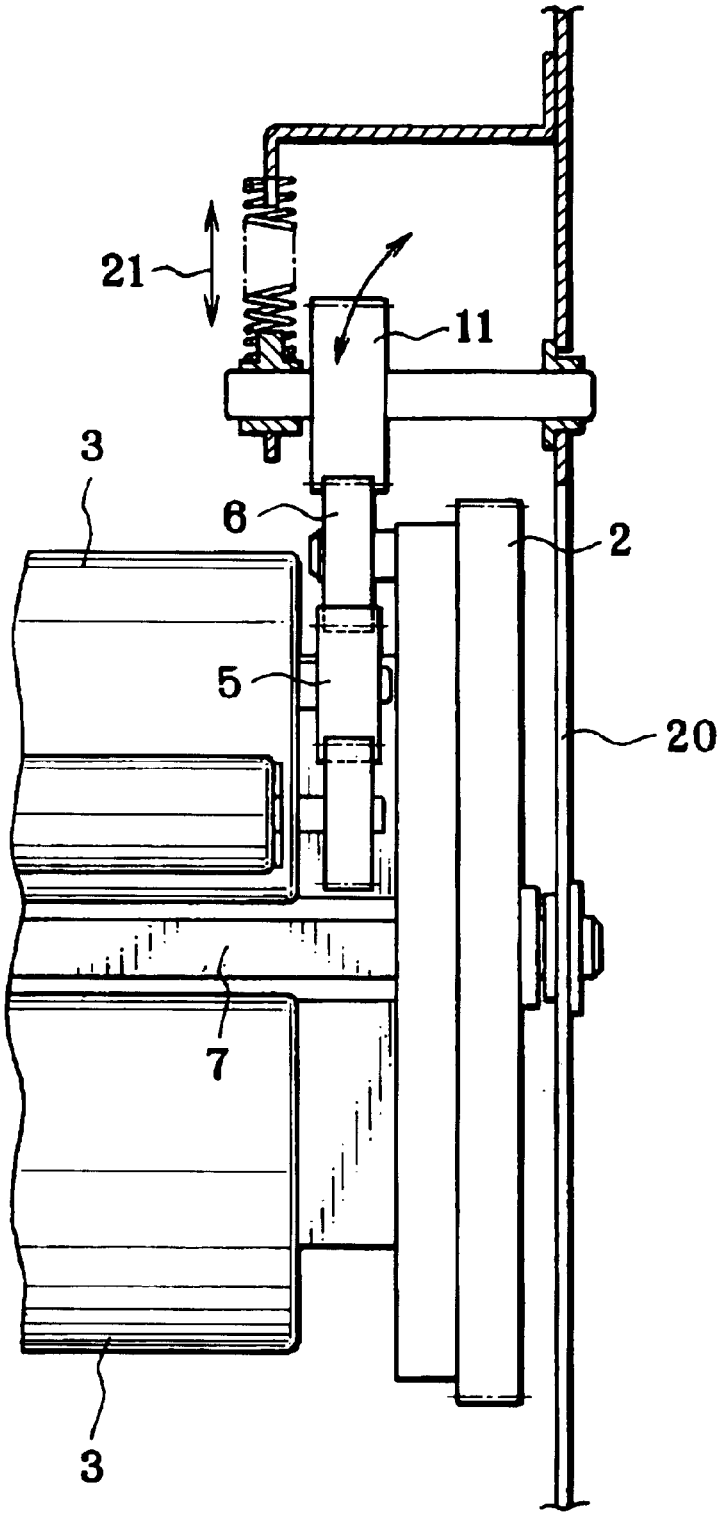
FIG. 7 is a side view showing the power transmitting section as shown in FIG. 5 and FIG. 6.

Instead of the one-way clutch, a single tumbler mechanism may be employed in the development member driving gear 11. In this case, the development member driving gear 11 may be supported such that its shaft can swing in a direction of a radial line extending from the center of the rotary developing unit 1 by the single tumbler mechanism so that the development member driving gear 11 can be neatly meshed with one of development input gears 6 for transmitting driving power. Hereinafter, embodiments employing a single tumbler mechanism will be described. FIG. 5 is an illustration showing a rotary developing unit of a dual motor driven type with an arrangement for preventing the damage of tooth tops at a driving power transmitting section relative to a development input gear, FIG. 6 is an illustration showing a rotary developing unit of a single motor driven type with an arrangement for preventing the damage of tooth tops at a driving power transmitting section relative to a development input gear, FIG. 7 is a side view showing a power transmitting section as shown in FIG. 5 and FIG. 6, and FIGS. 8(A), 8(B) are illustrations for explaining the retreating action in the event of collision between tooth tops.

In FIG. 5, the development member driving gear 11 is supported by a single tumbler mechanism not a gear with clutch mechanism. It should be understood that an electromagnetic clutch gear and a one-way clutch gear which can idle in the rotary unit driving direction may be employed. Other structure is the same as that in the embodiment shown in FIG. 1. As one of developer cartridges 3 is brought to a position facing the photoreceptor 10 by 90-degree rotation of the rotary developing unit 1, the development input gear 6 is meshed with the development member driving gear 11, thereby conducting the transmission of driving power. When tooth tops of the development input gear 6 and the development member driving gear 11 collide with each other, the shaft of the development member driving gear 11 is shifted along the radial line extending from the center of the rotary developing unit 1 by a single tumbler mechanism 21 in such a manner that the development member driving gear 11 retreats, whereby the development member driving gear 11 can be neatly meshed with the development input gear 6 according to the rotation of the development member driving gear 11. The single tumbler mechanism 21 is a supporting means for supporting the shaft of the development member driving gear 11 as a part of the power transmitting portion such that the shaft can swing in the direction of the radial line extending from the center of the rotary developing unit 1.

Since the rotary unit driving action and the development member driving action are alternately repeated and are never conducted at the same time, only a single motor is enough for the rotary developing unit, instead of two motors of a development member driving motor 13 and a rotary unit driving motor 15 in the embodiment shown in FIG. 5. An embodiment in which a single motor is used is shown in FIG. 6. In the rotary developing unit of a single motor driven type as shown in FIG. 6, a rotary input gear 2 is meshed with a rotary unit driving gear 17 and is driven by a motor pinion 12 through an electromagnetic clutch gear 16 and the rotary unit driving gear 17. In this case, for conducting the rotary unit driving action, a development member driving motor 13 drives a motor pinion 12 to rotate in the clockwise direction and the electromagnetic clutch gear 16 is set to its coupled state. For conducting the development member driving action, the development member driving motor 13 drives the motor pinion 12 to rotate in the counter-clockwise direction while the electromagnetic clutch gear 16 is set to its uncoupled state. In this case, the development input gear 6 is driven to rotate in the same direction of the driving direction of the rotary developing unit 1 by the development member driving gear 11.

By employing a common motor as driving means, vibration produced by one of the actions can be reduced by vibration produced by the other action. Immediately after the rotary unit driving action is finished, the same motor is driven to rotate in the reverse direction for starting the development member driving action, thereby quickly damping vibration produced by the rotation of the rotary developing unit and thus preventing deterioration of image quality due to unevenness and/or registration error resulting from such vibration.

In the gear train for the rotary unit driving action, the rotary input gear 2 is always meshed with the motor pinion 12 via the rotary unit driving gear 17 and the electromagnetic clutch gear 16 both during the rotary unit driving action and during the development member driving action, so the engagement and disengagement action of teeth is not conducted. Therefore, the problem of collision between tooth tops is basically not caused. In the gear train for the development member driving action, however, the problem may be caused. When the developer cartridges 3 are moved to the position facing the photoreceptor 10 one by one, some tooth tops of the development member driving gear 11 may collide with some tooth tops of the development input gear 6, causing damage of tooth tops and producing vibration and thus deteriorating the image quality. This is true both in the dual motor driven type and the single motor driven type.

The single tumbler mechanism 21 is a relief mechanism for damping the impact generated in the collision and reducing the damage of tooth tops. The mechanism is shown in a side view of FIG. 7. The shaft of the development member driving gear 11 is supported at its one end to a body frame 20 in such a manner that the shaft can swing in a direction of a radial line extending from the center of the rotary developing unit 1 by the single tumbler mechanism 21. In addition, the development member driving gear 11 is biased by a spring toward the center of the rotary developing unit 1 so that the development member driving gear 11 can be meshed with one of the development input gears 6.

As shown in FIG. 5 and FIG. 6, one of the development rollers can be brought into contact with the photoreceptor 10 on a radial line extending from the center of the rotary developing unit 1 and the development member driving gear 11 is biased and supported to swing by the single tumbler mechanism 21 such that the development member driving gear 11 can be meshed with one of the development input gears 6 on a radial line extending from the center of the rotary developing unit 1. According to this structure, even when impact is generated by collision between tooth tops of the development member driving gear 11 and the development input gear 6, the development member driving gear 11 is shifted against the spring force not to affect the contact portion between the development roller and the photoreceptor 10.

Figures 8A, 8B:
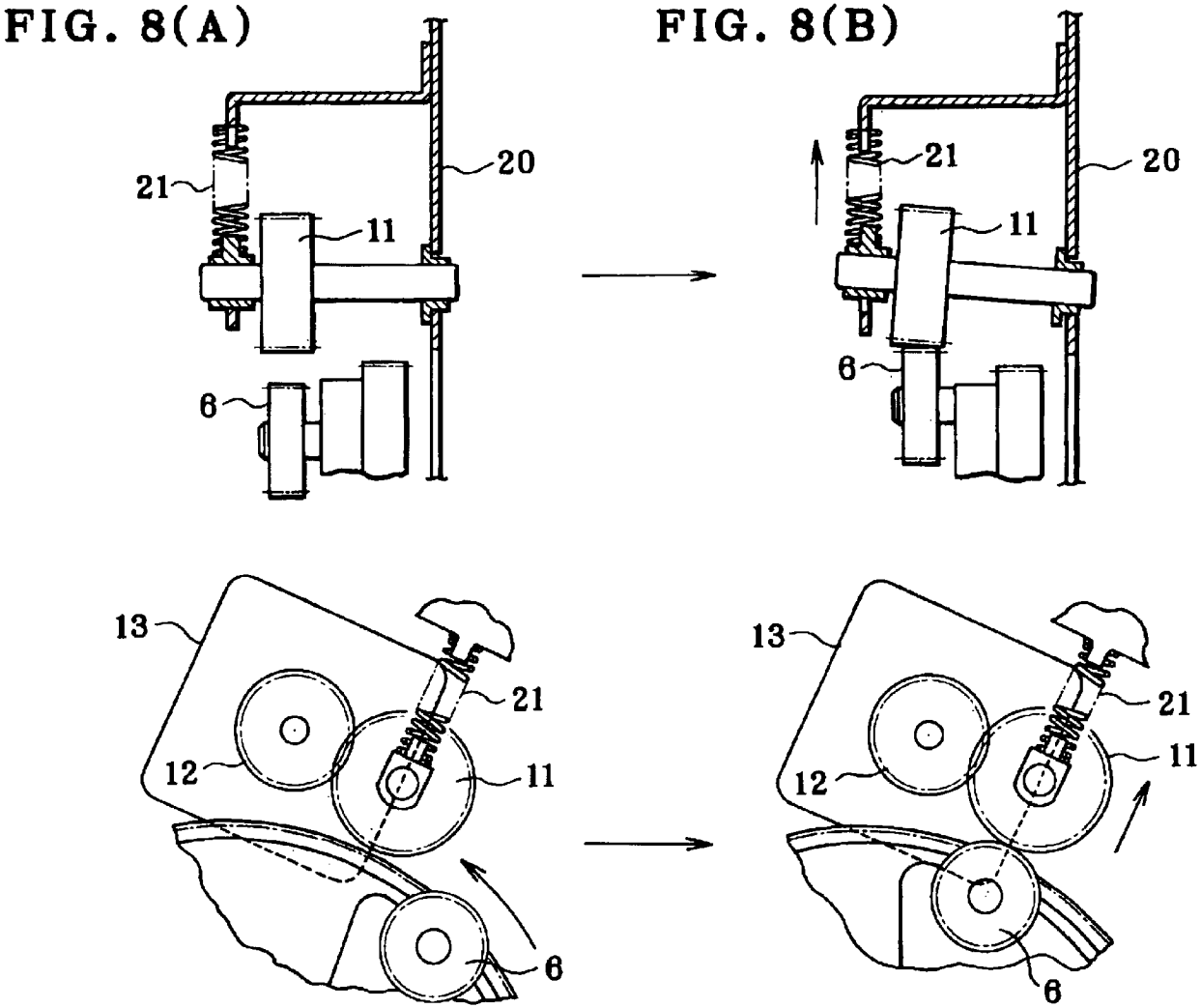
FIGS. 8(A), 8(B) are illustrations for explaining the retreating action in the event of collision between tooth tops.

When the development input gear 6 is moved to a position where it can be meshed with the development member driving gear 11 according to the rotary unit driving action and collides with some tooth tops, the development member driving gear 11 is shifted in a direction away from the rotary developing unit 1 along a radial line extending from the center of the rotary developing unit 1 as a result of the function of the single tumbler mechanism 21 as shown in FIG. 8(A) and FIG. 8(B). Then, tooth tops of the development input gear 6 slide in valleys of the teeth of the development member driving gear 11 while the development input gear 6 moves to the exactly meshable position according to the rotary unit driving action, whereby the development input gear 6 can be neatly meshed with the development member driving gear 11. Alternatively, in case that the collision between tooth tops can not cancelled even when the development input gear 6 reaches the exactly meshable position, the development input gear 6 can be neatly meshed with the development member driving gear 11 according to the movement of the tooth tops of the gears at the beginning of the development member driving action, that is, when the development member driving motor 13 is started to rotate for the development member driving action.

In a case that the development member driving gear 11 supported by the single tumbler mechanism 21 is positioned upstream of the motor pinion 12 in the rotating direction of the rotary developing unit as shown in FIG. 8(A) and FIG. 8(B), when the development member driving gear 11 swings, the development member driving gear 11 rotates in a direction attacking the development input gear 6 to be meshed with the development member driving gear 11 because of the coupling with the motor pinion 12. In a case that the development member driving gear 11 is positioned downstream of the motor pinion 12 in the rotating direction of the rotary developing unit i.e. an inverse arrangement from that of the illustrated case, when the development member driving gear 11 swings, the development member driving gear 11 rotates in a direction away from the development input gear 6 to be meshed with the development member driving gear 11 because of the coupling with the motor pinion 12. Accordingly, the later case should be advantageous to allow smooth reciprocating motion of the single tumbler mechanism 21.

In case of the development member driving gear 11 employing a one-way clutch as shown in FIG. 1 and FIG. 3, there is a condition that the rotary input gear 2 and the development input gear 6 rotate in the same direction. In case of single motor driven type as shown in FIG. 3 and FIG. 6, both the normal rotation and the reverse rotation are switched and driven by one motor. In an arrangement shown in FIG. 3 which is of a single motor driven type and in which a one-way clutch is employed in the development member driving gear 11, the rotary input gear 2 and the development input gear 6 are driven to rotate in the same direction. If the development member driving gear employs an electromagnetic clutch not a one-way clutch and two motors are used for driving, the driving directions of the rotary input gear and the development input gear can be selected, respectively.

Figure 9G:
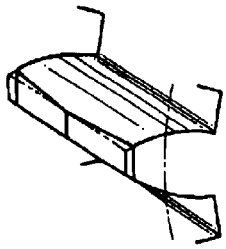
FIGS. 9(A)–9(G) are illustrations showing various tooth configurations designed for reducing the impact and damage generated in the collision between tooth tops.
Figure 9F:
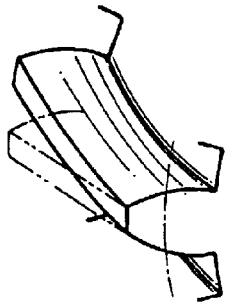
Figure 9E:
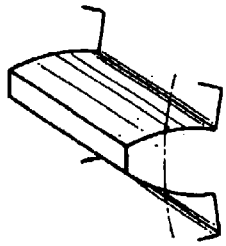
Figure 9D:
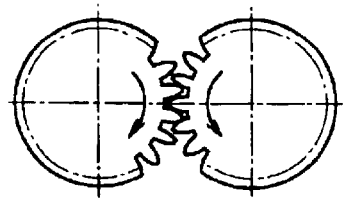
Figure 9C:
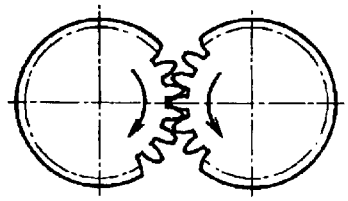
Figure 9B:
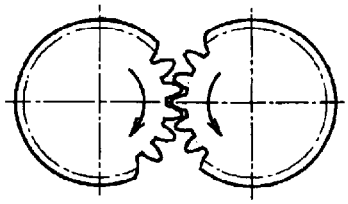
Figure 9A:
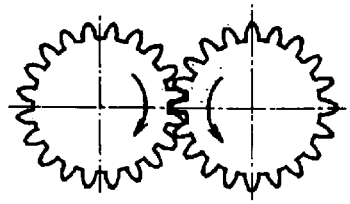

FIGS. 9(A)–9(G) are illustrations showing various tooth configurations designed for reducing the impact and damage generated in the collision between tooth tops. In each figure, a dashed line indicates a pitch circle, a thin line indicates a tip circle, and arrows indicate the rotational directions of a driving-side gear and a driven-side gear, respectively. FIG. 9(A) shows details of a tooth configuration of a normal involute gear, and driving- and driven-side gears. In comparison with the involute tooth shown in FIG. 9(A), various tooth configurations are designed for reducing the impact and damage generated in the collision between tooth tops. As an example, FIG. 9(B) shows gears in which a tip portion of each tooth is cut on a side not the contact side of the tooth. The cutting is limited to a position between the pitch circle and the tip circle. FIG. 9(C) shows high-tooth gears having high teeth of which rate is 30%. FIG. 9(D) shows high-tooth gears having high teeth of which tops are rounded. According to Japanese Industrial Standard, the involute tooth consists of curves so that it is believed that the height limit is the position of a point where two curves meet with each other at the top. A gear with too deep bottom should be "undercut configuration" in view of mold construction so that there is a limit of mold releasing.

In comparison with FIG. 9(E) which is a perspective view showing the normal involute tooth, FIG. 9(F) and FIG. 9(G) show tooth configurations designed for reducing the impact and damage generated in the collision be between tooth tops, in which FIG. 9(F) is a perspective view of a helical gear and FIG. 9(G) is a perspective view of a tooth having inclined surfaces in the longitudinal direction of the tooth.

The development input gear 6 moves to the position to be meshed with the one-way clutch gear 11 according to the rotary unit driving action and the rotary developing unit stops at the developing position. If some tooth tops still collide with each other in this state, the gears are neatly meshed with each other according to the movement of the tooth tops of the gears when the development member driving motor 13 is started to rotate for the development member driving action. In this case, vibration is generated due to impact when the gears are meshed so that the actual development is started before the vibration does not die out completely. By employing gears having any one of the aforementioned tooth configurations, the gears can be smoothly meshed with each other until the rotary developing unit stops at the developing positions, whereby the actual development can be started without vibration as mentioned.

Figure 10:
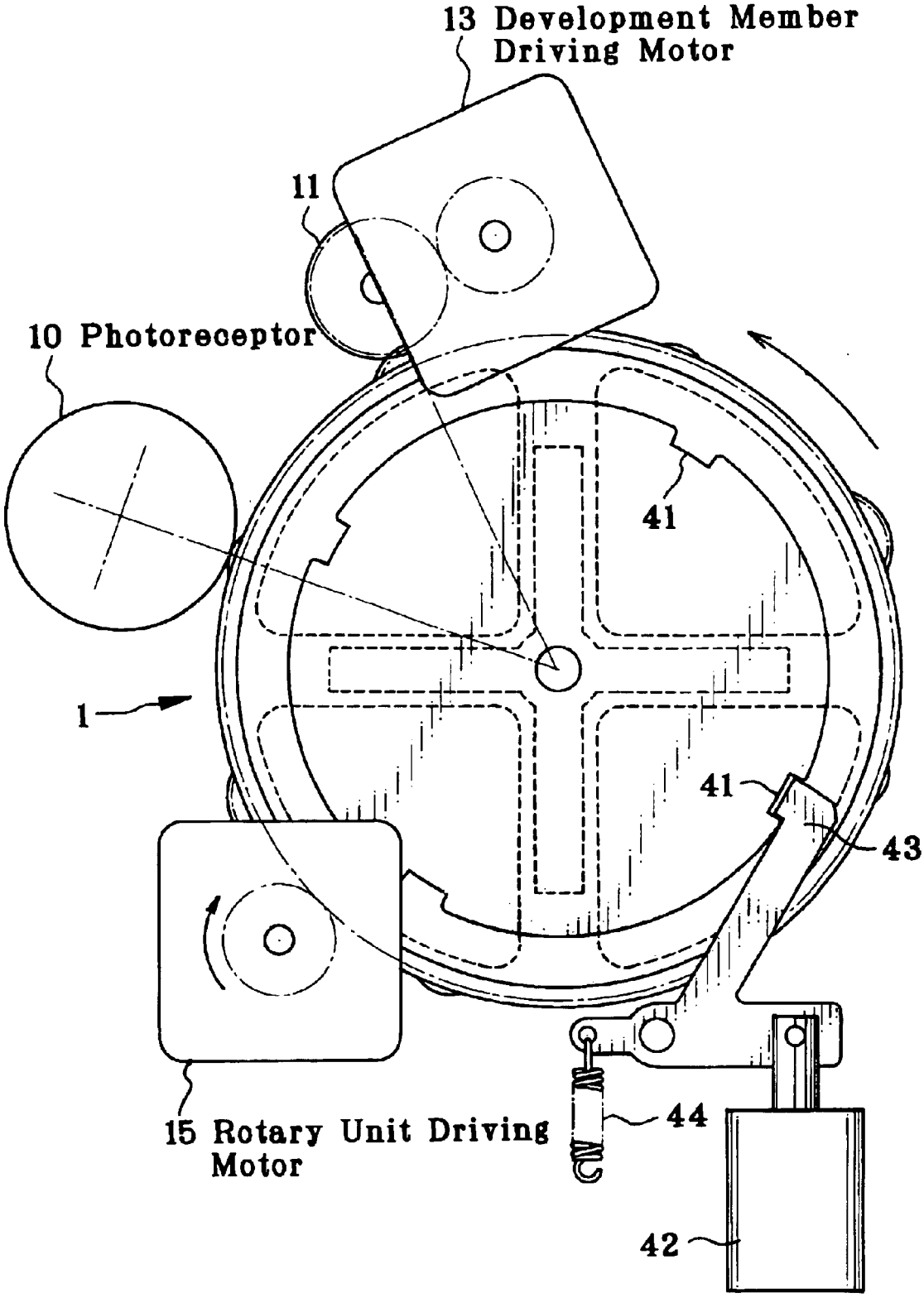
FIG. 10 is an illustration showing an arrangement with a rotary unit locking mechanism.

FIG. 10 is an illustration showing an arrangement with a rotary unit locking mechanism, in which numeral 41 designates a receiving concavity, 42 designates a solenoid, 43 designates a locking lever convexity, and 44 designates a spring. For example, as shown in FIG. 10, a rotary unit locking mechanism for stopping and retaining the rotary developing unit 1 at a desired position comprises receiving concavities 41 formed in the outer periphery of the rotary developing unit 1 and a locking lever convexity 43. By pivotally moving the locking lever convexity 43 to be fitted (engaged) in one of the receiving concavities 41, the rotary developing unit 1 is stopped at a desired position. The locking lever convexity 43 is operated to pivot about a pivotal axis by a solenoid 42 as a switching device and is locked at a position where the development roller of one of the developer cartridges faces the photoreceptor 10.

In the locking mechanism shown in FIG. 10, the spring 44 applies a force for retaining the locked state to the engaging portion, thereby preventing the lever from moving due to its weight in a direction canceling the engagement. Since the development roller and the photoreceptor 10 rotate and abut on each other, a reaction force acting to rotate the rotary developing unit 1 is generated to and a force acting to cancel the engagement is generated as an effect of the reaction. Therefore, the spring 44 is set to give a force enough for retaining the engaged state against the force acting to cancel the engagement. In response to this, the solenoid 42 is set to provide a force of extending the spring 44 against the spring force in order to cancel the engagement.

It should be noted that the aforementioned arrangement is just a major example and that the same is true of a case with a single motor. Of cause, there are various locking mechanisms. For instance, a reverse operation clutch is disposed which can be meshed with a gear of a gear train (driving-side gear train) rotating the rotary developing unit such that the reverse operation clutch is engaged with the gear so as to hold the rotary developing unit at a predetermined developing position when not energized and is disengaged from the gear to allow the rotation of the rotary developing unit for changing color when energized.

Figure 11:
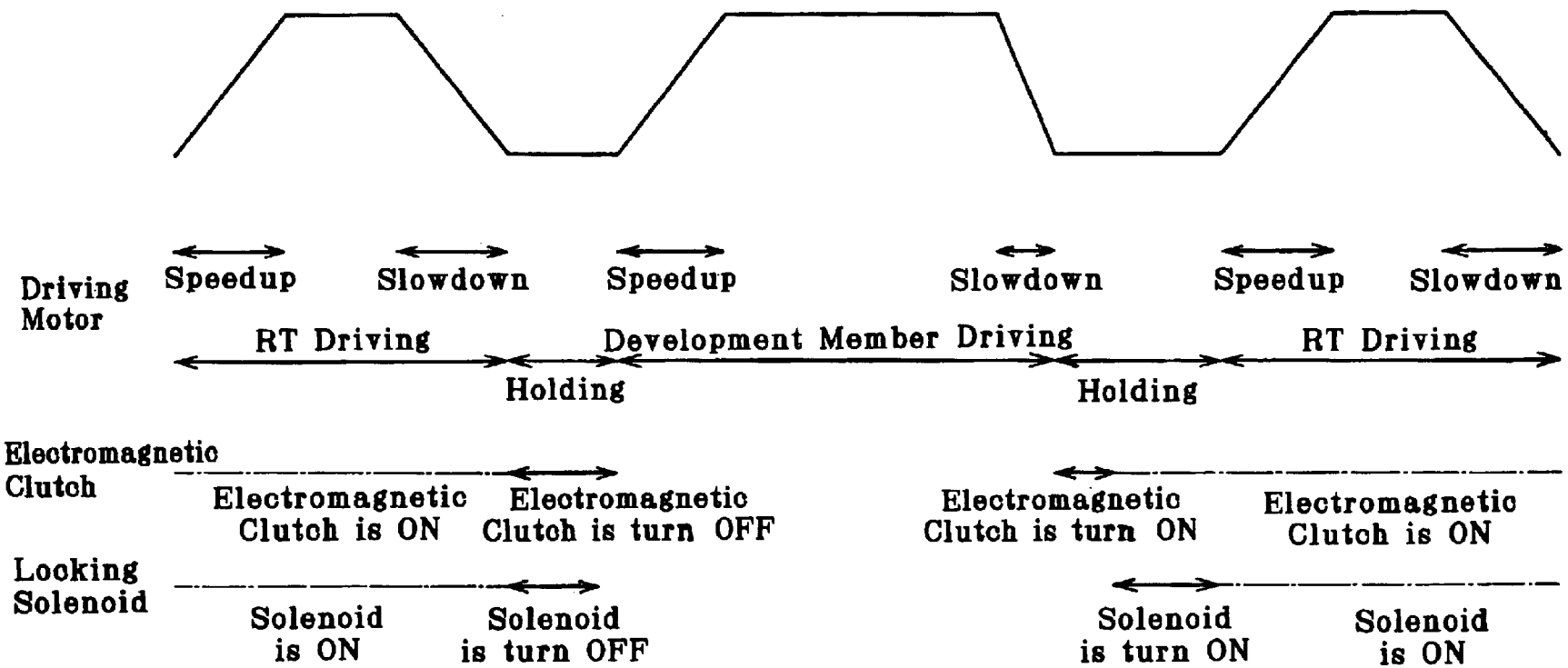
FIG. 11 is a diagram for explaining the operational sequence of a motor, a clutch and a locking solenoid.
Figure 12A:
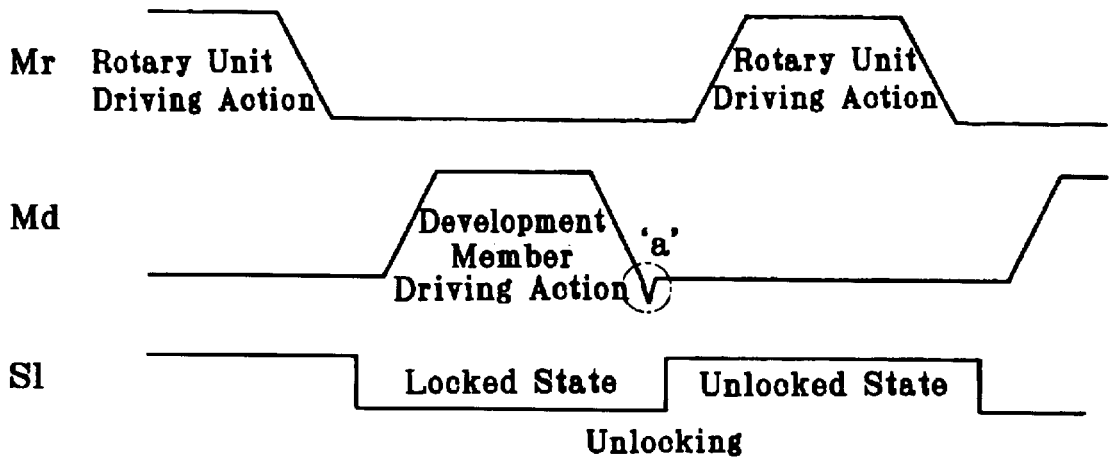
FIGS. 12(A), 12(B) are diagrams for explaining the operational sequence for switching between the rotary unit driving action and the development member driving action and for locking/unlocking the rotary developing unit.
Figure 12B:
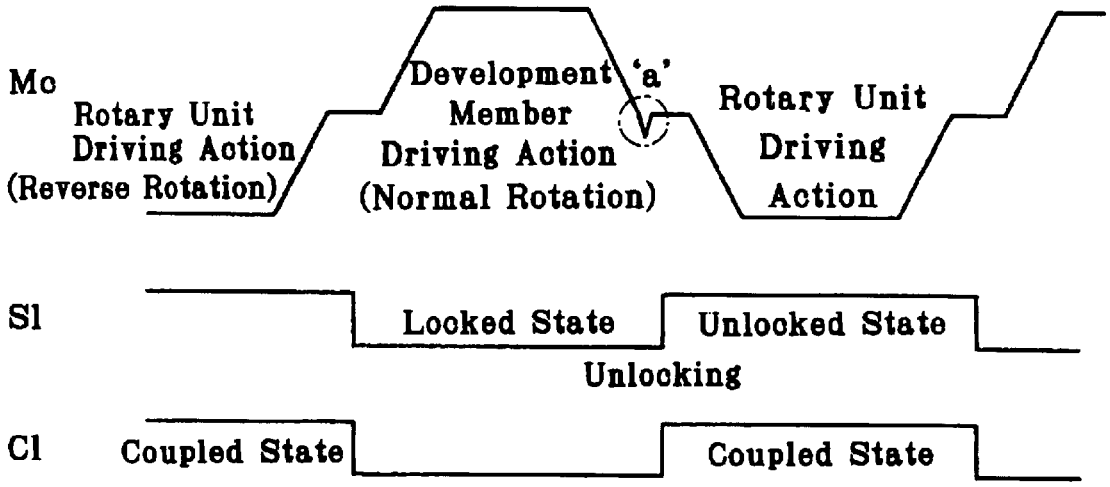
Figure 13:
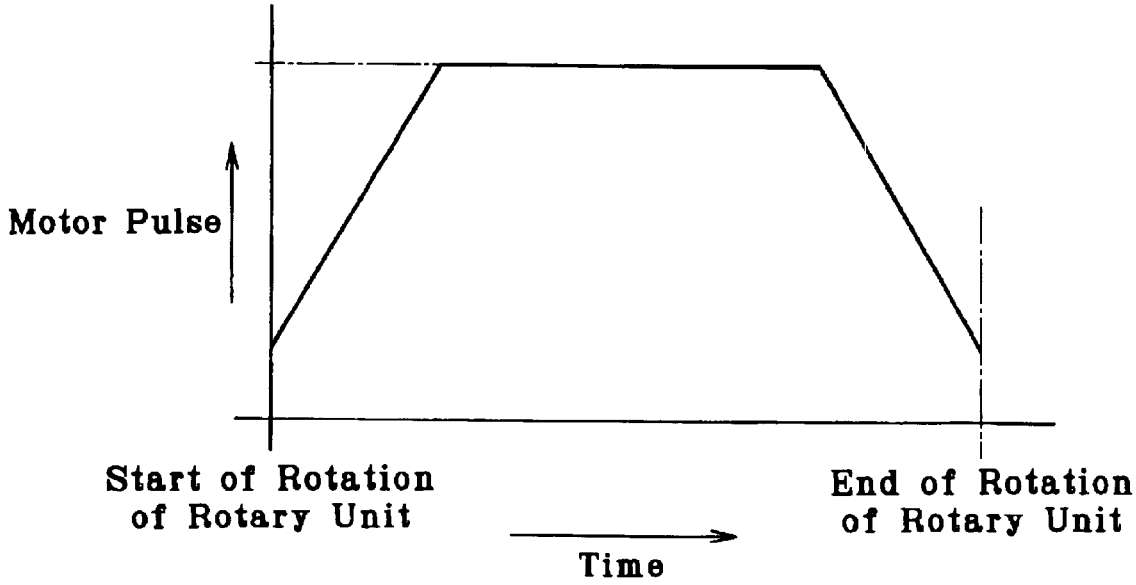
FIG. 13 is a graph for explaining the motor driving sequence for changing color.
Figure 14:
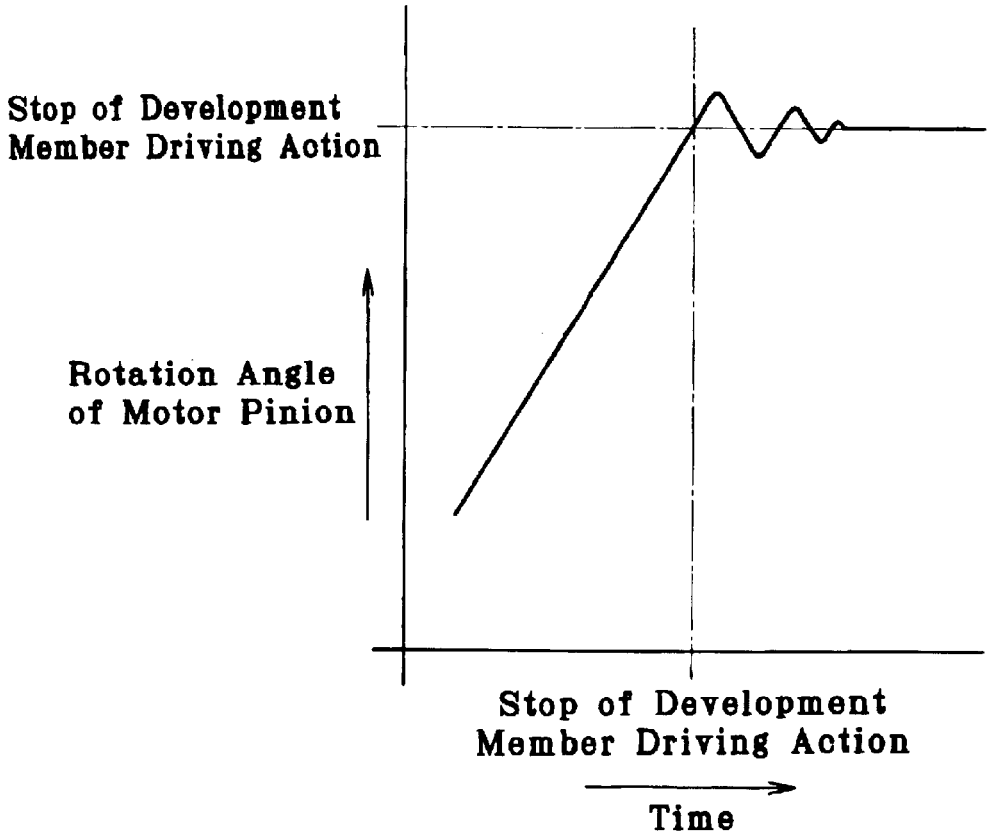
FIG. 14 is a graph for explaining the behavior of a motor pinion when the development member driving action is finished.

FIG. 11 is a diagram for explaining the operational sequence of the motor, the clutch and the solenoid for the rotary unit locking mechanism (hereinafter, referred to as the locking solenoid), FIGS. 12(A), 12(B) are diagrams for explaining the operational sequence for switching between the rotary unit driving action and the development member driving action and for locking/unlocking the rotary developing unit, FIG. 13 is a graph for explaining the motor driving sequence for changing color, and FIG. 14 is a graph for explaining the behavior of the motor pinion when the development member driving action is finished.

In the operational sequence of the motor, the clutch and the locking solenoid, the rotary unit driving (RT driving) action and the development member driving action are alternatively repeated with holding intervals. The motor is driven along a velocity curve composed of an acceleration (speedup) period, a constant speed period, and a deceleration (slowdown) period in each action. On the other hand, the electromagnetic clutch is ON over the period of the rotary unit driving action to transmit power from the driving motor to the rotary input gear and is OFF over a period from one holding interval and the next holding interval through the development member driving action. In response to the ON of the electromagnetic clutch, the locking solenoid is ON over the period of the rotary unit driving action to cancel the engagement for retaining the rotary developing unit. The solenoid is OFF over the period of the development member driving action to stop the rotation of the rotary developing unit.

In FIG. 12(A), the rotary unit driving motor is designated by "Mr" and the development member driving motor is designated by "Md". In the arrangement shown in FIG. 1 and FIG. 2 having both these motors, the development member driving motor "Md" is driven to rotate in reverse at the end 'a' of the development driving action. In FIG. 12(B), the driving motor which is common for the rotary unit driving action and the development member driving action is designated by "Mc". In the arrangement shown in FIG. 3 and FIGS. 4(A), 4(B), the driving motor "Mc" is driven to rotate in reverse, i.e. rotate in the same direction as that for the rotary unit driving action, at the end 'a' of the development driving action. On the other hand, the electromagnetic clutch "CI" is ON (in the coupled state) over the period of the rotary unit driving action to transmit the power from the driving motor "Mc" to the rotary input gear and is OFF over the period from one holding interval to the next holding interval through the development member driving action. In response to the ON of the electromagnetic clutch "CI" the locking solenoid "SI" is ON over the period of the rotary unit driving action to cancel the engagement for retaining the rotary developing unit. The locking solenoid "SI" is OFF over the period of the development member driving action to stop the rotation of the rotary developing unit.

Residual stress at the engaging portion between the receiving concavity 41 and the locking lever convexity 43 generates a force (reaction force) in a direction opposite to the direction of the development member driving action. Though the shaft of the gear normally rotates and the gear portion idles because of the function of the one-way clutch when the motor rotate in reverse, the gear portion is also rotated in reverse together with the motor shaft due to the reaction force, thereby removing the residual stress at the engaging portion and thus conducting the printing action without problems such as image defects.

The timing of rotating the motor in reverse is controlled to synchronize the reverse driving direction of the motor with the direction of vibration which is generated on the output shaft of the driving means due to the development member driving action. When the reverse driving direction of the motor is opposite to the direction of vibration at the beginning of reverse rotation, the torque exceeds the capacity of the motor so that the motor may be out of order. Even though the motor can operate, the vibration of the motor should be so large to produce image defects at image forming portions. By driving the motor at a timing enabling the synchronization of the reverse driving direction of the motor with the direction of the vibration generated on the output shaft of the driving means due to the development member driving action, such problem can be solved.

Since the repulsion of the residual stress acts on the engaging portion at the beginning of the reverse rotation, the motor should be subjected to zero load or minus load (braking force). By conducting the reverse rotation with electric current smaller than the normal current (current during the development member driving action), the vibration is suppressed, thereby preventing the production of image defects. The use of a stepping motor is preferable because the detailed control of pulse and current is enabled to achieve the best operation, thereby achieving the formation of high quality images.

When a pulse motor is used as the rotary unit driving motor, motor pulse is generated to correspond to its velocity curve as shown in FIG. 13. FIG. 13 plots frequency of the motor pulse as the ordinate and time as the abscissa. In case that the rotary unit driving action and the development member driving action are both conducted by a single motor, since the pinion vibrates just after the development member driving action is finished as shown in FIG. 14, reverse pulse is applied to coincide with the direction of the vibration. Because of the reverse pulse, the residual stress generated on the engaging portion can be removed by the reaction force of driving power, thereby preventing the failure of cancellation of the engagement and reducing the vibration generated due to the cancellation of the engagement.

It should be understood that the present invention is not limited to the aforementioned embodiments and various changes and modifications may be made. For example, though the gear, employing a one-way clutch and to be meshed with the development input gear of the rotary developing unit, is mounted to the body frame in the aforementioned embodiments, the one-way clutch gear may be arranged at any place from an idle gear or a motor gear to a gear directly driving a roller of a developer cartridge. Though a one-way clutch gear is employed as a driving-side gear to be meshed with development input gears in the aforementioned embodiments, an electromagnetic clutch gear may be employed or a combination of a single tumbler mechanism 21 and a one-way clutch gear may be employed instead of the one-way clutch gear.

As apparent from the above description, the present invention can provide a rotary developing device comprising a cylindrical rotary developing unit, a plurality of development members mounted around the periphery of the rotary developing unit, a rotary developing unit driving section for driving the rotary developing unit by a driving means, and a driving power transmitting section for transmitting the driving power by the driving means to the development members at a developing position, wherein the rotary developing unit is driven by the driving means to bring one of the development members to the developing position facing a photoreceptor and subsequently the transmission of the driving power to the development member is conducted. In the driving power transmitting section, the driving direction of the development members is set to be the same as the driving direction of the rotary developing unit and a simple additional structure employing an electromagnetic clutch or a one-way clutch is applied to the driving power transmitting section, thereby avoiding a collision of tooth tops between gears at the driving power transmitting section, damping the impact generated by a collision, and reducing vibration and damage of tooth tops. Therefore, it can prevent the production of image defects due to registration error.

Because the driving power transmitting section employs a clutch capable of coupling and uncoupling the gear train, the mesh between a development member driving gear and a development input gear can be smoothly conducted, thereby avoiding a collision of tooth tops between the gears, damping the impact generated by a collision, reducing vibration and noise, and reducing damage of tooth tops.

Further, the driving power transmitting section has a supporting means for supporting the shaft of a gear to be meshed with the development input gear to transmit the driving power in such a manner that the shaft can swing along a radial line extending from the center of the rotary developing unit, thereby avoiding a collision of tooth tops between gears which occurs at the driving power transmitting section when switching from the rotary unit driving action to the development member driving action, damping the impact generated by a collision, and reducing vibration and damage of tooth tops. Therefore, it can prevent the production of image defects due to registration error.

The driving power transmitting section employs a clutch capable of coupling and uncoupling the gear train, the driving direction of the development member is set to be the same as the driving direction of the rotary developing unit, and the supporting means is positioned downstream of the driving means in the rotational direction of the rotary developing unit, whereby the mesh between the development member driving gear and the development input gear can be smoothly conducted, thereby further avoiding a collision of tooth tops between the gears, damping the impact generated by a collision, reducing vibration and noise, and reducing damage of tooth tops.

The clutch is a one-way clutch and is disposed between a gear to be meshed with the development input gear of the rotary developing unit and the driving shaft of the gear in the driving power transmitting section, thereby enabling the automatic switching between coupling and uncoupling and thus achieving power saving. Further, the one-way clutch needs no time for conducting the coupling and uncoupling, thereby shortening the switching time. Furthermore, the one-way clutch can provide high degree of freedom of design as compared to an electromagnetic clutch, achieve power saving and simplification of control, and curb the rise in temperature, thus improving the driving reliability.

As for the driving means, a common driving means is provided for driving the rotary developing unit and driving the development members. A rotary developing unit driving section includes a clutch for coupling and uncoupling a gear train relative to an input gear of the rotary developing unit. The rotary developing unit has a locking mechanism for retaining the stopped state during the suspension of the rotary developing unit. In the driving means, reverse pulse is applied to coincide with the direction of vibration of a motor pinion just after the development member driving action is finished. The common driving means is set such that the rotation for driving the rotary developing unit is opposite to the rotation for driving the development member. Therefore, the coupling/uncoupling of either clutch can be done by rotation of the driving means (motor) in either direction so that the rotary unit driving action and the development member driving action can be conducted by the single motor. Further, the common driving means can retain the rotary developing unit in the stopped state during the development member driving action, yet smoothly cancel the stopped state, and quickly damp vibration, thereby forming high quality images without image defects such as unevenness and registration error resulting from such vibration.

According to the present invention, a rotary developing device comprising a cylindrical rotary developing unit, a plurality of development members mounted around the periphery of the rotary developing unit, a rotary developing unit driving section for driving the rotary developing unit by a driving means, a driving power transmitting section for transmitting the driving power by the driving means to the development members at a developing position, a one-way clutch which is arranged between the driving means and the driving power transmitting section to connect/disconnect a gear train, and a retaining means for retaining the rotary developing unit at a developing position, wherein the rotary developing unit is driven by the driving means to bring one of the development members to the developing position facing a photoreceptor and subsequently the transmission of the driving power to the development member is conducted. In the driving power transmitting section, the driving direction of the development members is set to be the same as the driving direction of the rotary developing unit. The retaining means retains the rotary developing unit at a developing position during the development member driving action and drives the driving means in reverse at the end of the development member driving action to allow the movement of the rotary developing unit. Therefore, the locking/unlocking can be smoothly conducted by a simple structure without vibration, thereby shortening the time for switching between the rotary unit driving action and development member driving action so as to achieve a large increase in speed of forming images, and forming high quality images without image defects such as unevenness and registration error resulting from such vibration.

The one-way clutch is disposed between a gear to be meshed with the development input gear of the rotary developing unit and the driving shaft of the gear in the driving power transmitting section. As for the driving means, a common driving means is provided for driving the rotary developing unit and driving the development members. The rotary developing unit driving section includes a clutch for coupling and uncoupling a gear train relative to an input gear of the rotary developing unit. The retaining means comprises a locking mechanism having a claw portion for stopping the rotation of the rotary developing unit and an operating portion for engaging/disengaging the claw portion. The switching between the rotary unit driving action and the development member driving action can be conducted by the normal rotation and reverse rotation of a single motor and further the switching time can be shortened, thereby achieving a large increase in speed and power saving. Further, the one-way clutch can provide high degree of freedom of design as compared to an electromagnetic clutch, achieve power saving and simplification of control, and curb the rise in temperature, thus improving the driving reliability.

As for the driving means, driving means are separately provided for driving the development members and for driving the rotary developing unit. The driving means for driving the rotary developing unit is also used as the retaining means. When the driving means drives in reverse at the end of the development member driving action, reverse pulse is applied to coincide with the direction of vibration of a motor pinion just after the development member driving action is finished. Therefore, the locking/unlocking can be smoothly conducted without vibration and the time for switching between the rotary unit driving action and development member driving action can be shortened, thereby achieving a large increase in speed of forming images, and forming high quality images without image defects such as unevenness and registration error resulting from such vibration.

By employing a stepping motor as the driving means, the positioning accuracy is increased and the switching action at a high speed with high accuracy is achieved. In the driving power transmitting section, the development input gear is mounted to the frame of the rotary developing unit so that the development member driving action is conducted via the development input gear. Therefore, even if a development member is replaced, no influence is exerted on the meshing part.

According to the present invention, as discussed in the above, the switching between the rotary unit driving action and the development member driving action can be smoothly conducted to shorten the time, thereby achieving a large increase in speed of multi-color development. The coupling/uncoupling is automatically conducted, the switching between the rotary unit driving action and the development member driving action can be conducted by the normal rotation and reverse rotation of a single motor, thereby improving the driving reliability and achieving the simplification of substrate, reduction in controlling load, and power saving. Further, high quality images can be formed without image defects such as unevenness and registration error resulting from such vibration.

What is claimed is:

1. A rotary developing device comprising:

a cylindrical rotary developing unit, a plurality of development members mounted around a periphery of said rotary developing unit, a rotary developing unit driving section for driving said rotary developing unit by a driving means, and a driving power transmitting section for transmitting a driving power to said development members at a developing position by said driving means, wherein said rotary developing unit is driven by said driving means to bring one of said development members to the developing position facing a photoreceptor and subsequently the transmission of the driving power to said development member is conducted, wherein, said driving power transmitting section has a supporting means for supporting a shaft of a gear to be meshed with a development input gear to transmit the driving power to the development member in such a manner that the shaft can swing along a radial line extending from the center of said rotary developing unit.

2. A rotary developing device as claimed in claim 1, wherein said driving power transmitting section is provided with a clutch for coupling or uncoupling gears of a gear train.

3. A rotary developing device as claimed in claim 1 or 2, wherein in said driving power transmitting section, a driving direction of said development members is set to be the same as a driving direction of said rotary developing unit.

4. A rotary developing device as claimed in claim 1, wherein said supporting means is positioned downstream of said driving means in a rotational direction of said rotary developing unit.

5. A rotary developing device as claimed in claim 2, wherein said clutch is a one-way clutch.

6. A rotary developing device as claimed in claim 5, wherein said one-way clutch is disposed between a gear to be meshed with the development input gear of said rotary developing unit and the driving shaft of said gear in said driving power transmitting section.

7. A rotary developing device as claimed in claim 1, wherein as said driving means, a common driving means is provided for driving the rotary developing unit and driving the development members and said rotary developing unit driving section includes a clutch for coupling and uncoupling a gear train relative to an input gear of the rotary developing unit.

8. A rotary developing device as claimed in claim 7, wherein said rotary developing unit has a locking mechanism for retaining a stopped state during the suspension of the driving of the rotary developing unit.

9. A rotary developing device as claimed in claim 7, wherein, in said driving means, reverse pulse is applied to coincide with a direction of vibration of a motor pinion just after a development member driving action is finished.

10. A rotary developing device as claimed in claim 7, wherein said common driving means is set such that the rotational direction thereof for driving said rotary developing unit and a rotational direction thereof for driving said development member are opposite to each other.

11. A rotary developing device comprising:

a cylindrical rotary developing unit, a plurality of development members mounted around a periphery of said rotary developing unit, a rotary developing unit driving section for driving said rotary developing unit by a driving motor, and a driving power transmitting section for transmitting a driving power to said development members at a developing position by said driving motor, wherein said rotary developing unit is driven by said driving motor to bring one of said development members to the developing position facing a photoreceptor and subsequently the transmission of the driving power to said development member is conducted, wherein, said driving power transmitting section has a support for supporting a shaft of a gear to be meshed with a development input gear to transmit the driving power to the development member in such a manner that the shaft can swing along a radial line extending from the center of said rotary developing unit.

* * * * *